US006299375B1

(12) United States Patent
Abe

(10) Patent No.: US 6,299,375 B1
(45) Date of Patent: Oct. 9, 2001

(54) CHIP FOR A BALL POINT PEN

(75) Inventor: Uichi Abe, Hasuda (JP)

(73) Assignee: Zebra Co., Ltd., Tokyo (JP)

( * ) Notice: Subject to any disclaimer, the term of this patent is extended or adjusted under 35 U.S.C. 154(b) by 0 days.

(21) Appl. No.: 09/753,615

(22) Filed: Jan. 4, 2001

(30) Foreign Application Priority Data

Apr. 17, 2000 (JP) ..... 12-115538

(51) Int. Cl.[7] ..... B43K 7/10
(52) U.S. Cl. ..... 401/214; 401/216
(58) Field of Search ..... 401/209, 214, 401/216, 219, 208, 212

(56) References Cited

U.S. PATENT DOCUMENTS 3,554,660 * 1/1971 Woods ..... 401/214
4,198,172 * 4/1980 Meislik ..... 401/214
5,421,664 * 6/1995 Okamoto ..... 401/214
5,876,142 3/1999 Furukawa .
5,906,447 5/1999 Horikoshi .
5,915,866 6/1999 Furukawa .
5,929,135 7/1999 Wasai et al. .

FOREIGN PATENT DOCUMENTS 0621141 10/1994 (EP) .
0712737 5/1996 (EP) .

* cited by examiner

*Primary Examiner*—Gregory L. Huson
*Assistant Examiner*—Tuan Nguyen
(74) *Attorney, Agent, or Firm*—Greenblum & Bernstein P.L.C.

(57) ABSTRACT

The present invention's purpose is to provide a high quality chip for a ball-pointed pen in which air bubbles are not left in the centrifugal separating processing when the refill is manufactured. There is provided a chip for a ball-pointed pen in which a transfer ball held in a ball house at the extremity end in a holder is biased from a rear part by a resilient member, wherein the resilient member is received at its rear end by a plurality of small projections integrally arranged in a circumferential direction at an inner circumferential surface of the metallic holder, thereby when deaeration is performed in the centrifugal separating processing at the manufacturing stage of refill, some air bubbles within the holder are passed between the plurality of small projections and moved smoothly in a rearward direction.

8 Claims, 4 Drawing Sheets

CHIP FOR A BALL POINT PEN

BACKGROUND OF THE INVENTION

1. Field of the Invention

This invention relates to a chip for a ball-pointed pen, and more particularly a chip for a ball-pointed pen which is suitable for such a ball-pointed pen as one containing shearing reduced viscous ink.

2. Description of the Related Art

In this kind of chip for a ball-pointed pen of the prior art, there is provided a chip in which a transfer ball held in a ball house at the extremity end of a holder is resiliently biased by a resilient member from a rear part of it, the resilient member is received by a sleeve fixed to the rear part in the holder and the transfer ball is closely contacted with the inward directed extremity end edge within the ball house in order to prevent a writing state from becoming blurred or a non-writing state from occurring or avoid an ink leakage and the like.

However, since the refill having the chip for the ball-pointed pen at its extremity end is manufactured at the stage in which the chip is fitted to an ink-storing pipe filled with ink in advance, some air bubbles contained during manufacturing of ink, or air bubbles entered when the chip is fitted or some fine air bubbles generated after collapsing of these air bubbles and the like are left during the manufacturing stage.

Then, these air bubbles are deaerated at a centrifugal separating processing at its subsequent stage. That is, the ink storing pipe having the chip fitted thereto is applied to the centrifugal separating machine under a state in which the transfer ball side of the extremity end of the chip is faced to or directed to the centrifugal direction. Then, the ink having a high specific weight is collected at the extremity end in the chip and in turn the air bubbles having a low specific weight are moved to the rear part of the ink-storing pipe and deaerated at the opening part of the rear end of it.

However, in accordance with the aforesaid prior art chip for a ball-pointed pen, the air bubbles remained in the chip when the refill is manufactured are engaged with the circular front end surface of the sleeve receiving the resilient member and do not move more rearwardly, resulting in that the air bubbles are sometimes left in the holder and it has been felt anxious about producing some inferior operations such as becoming blurred of writing or non-writing due to the residual presence of the air bubbles.

SUMMARY OF THE INVENTION

Thus, the present invention has been invented in view of the aforesaid circumstances found in the prior art and it is an object of the present invention to provide a high quality chip for a ball-pointed pen in which some air bubbles are not left during the centrifugal separating process when the refill is manufactured.

As the technical means of the present invention for resolving the aforesaid problem, claim 1 provides a chip for a ball-pointed pen in which a transfer ball held in a ball house at the extremity end in a holder is biased from a rear part by a resilient member characterized in that said resilient member is received at its rear end by a plurality of small projections integrally arranged in a circumferential direction at an inner circumferential surface of a metallic holder.

In accordance with the aforesaid technical means, since the resilient member is received only by a plurality of small projections in a circumferential direction, a plurality of small projections and the inner circumferential surface of the holder become scarcely hindrance when deaeration is performed in the centrifugal separating processing at the manufacturing stage of refill, resulting in that the air bubbles in the holder are moved smoothly in a rearward direction.

In addition, as already described in claim 2, said plurality of small projections are made as cut pieces formed by a broach machining at the rear side of the holder, resulting in that the small projections receiving the resilient member can be formed easily and within a short period of time. In this case, it is preferable that the holder is formed by material having a high rigidity so as to prevent the cut pieces from being fallen or some cut powder from being generated.

DESCRIPTION OF THE PREFERRED EMBODIMENT(S)

Figure 1:
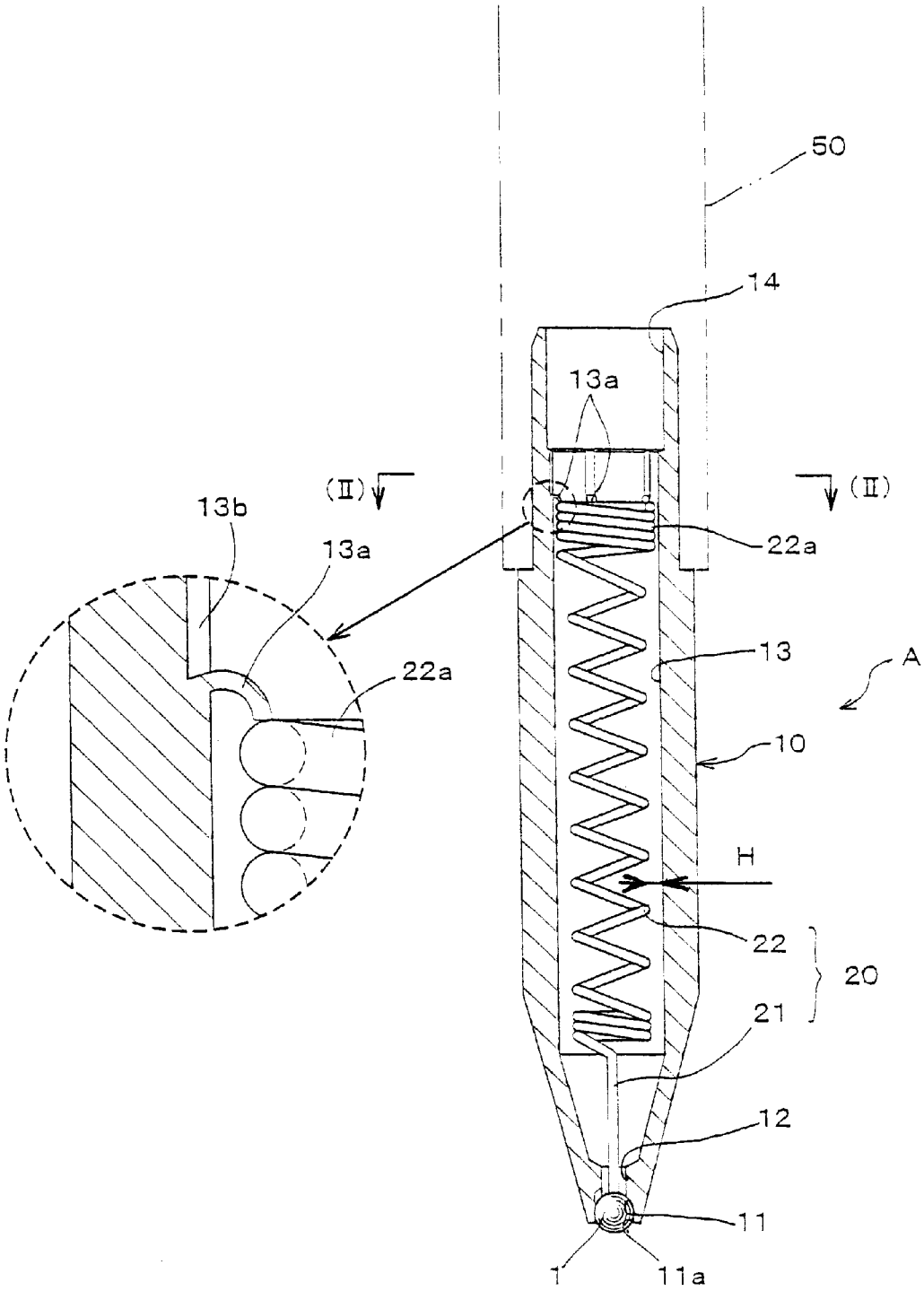
FIG. 1 is a longitudinal section for showing on e example of a chip for a ball-pointed pen of the present invention.

Referring now to the drawings, the preferred embodiment of the present invention will be described as follows.

Figure 2:
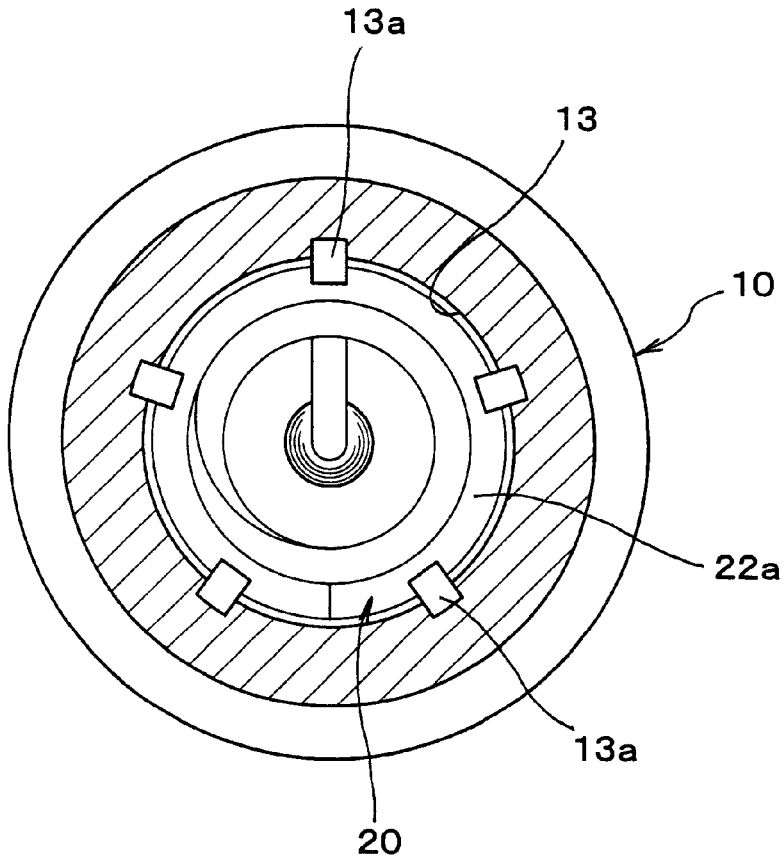
FIG. 2 is a sectional view taken along line (II)—(II) in FIG. 1.

FIGS. 1 and 2 illustrate one example of a chip for a ball-pointed pen of the present invention.

This chip A is comprised of a transfer ball 1 and a resilient member 20 for biasing the transfer ball 1 from a rear side within a holder 10 showing a substantial fine leading cylindrical shape and then the rear end of the resilient member 20 is received by a plurality of small projections 13*a* integrally arranged at the inner circumferential surface of the holder 10 in a circumferential direction. Then, this chip A is fitted to an ink storing pipe 50 filled with ink in advance to constitute a refill of the ball-pointed pen.

The inner segment of the holder 10 is made such that there is provided a communicated state among each of the segments of a ball house 11 for rotatably holding the transfer ball 1; a narrowed ink feeding hole 12 at the rear side of the ball house 11; an ink passage 13 of which extremity end is gradually decreased in its diameter toward the ink feeding hole 12; and a broach feeding segment 14 in which a rear side of the ink passage 13 is slightly widened at its diameter in such a way that a broach 40 to be described later may easily be inserted.

Further, the resilient member 20 is inserted into this holder 10 under a state in which the transfer ball 1 is pushed against an inward directed extremity end 11*a* in the ball house 11 and a plurality of small projections 13*a* for receiving the rear end of the resilient member 20 are formed at the rear side of the ink passage 13.

The small projections 13*a* are cut pieces in which their extremity ends are formed to be wound and raised toward the front end of the holder 10 by a broach machining operation to be described later, wherein material quality of the holder 10 is of metallic material having a high rigidity to cause the projections to be formed without being cut or fallen and their cut powders are scarcely generated. As preferable material quality for the holder 10, stainless steel material is used.

The resilient member 20 is made such that a linear straight segment 21 is integrally formed at the extremity end of a coil-like spring segment 22, and a close contacted coil-like seat wound segment 22*a* which is wound in a larger diameter than that of the spring segment 22 is integrally formed at the rear end of the spring segment 22.

The spring segment 22 is provided with a clearance H between its outer diameter surface and the inner surface of the holder 10 so as to cause the air bubbles to be smoothly moved when the deaeration processing is carried out at the stage of manufacturing the refill.

In addition, the seat wound segment 22*a* is a location where its diameter is expanded to cause it to be hung at the parts feeder feeding-out segment when the chip A is manufactured. That is, when the chip A is manufactured, the resilient member 20 is fed out while it is being hung by the seat wound segment 22*a* under a state in which the straight segment 21 is being faced downwardly due to its weight balance.

Then, an assembling order of the chip A having the aforesaid configuration will be described in detail.

Figure 3A:
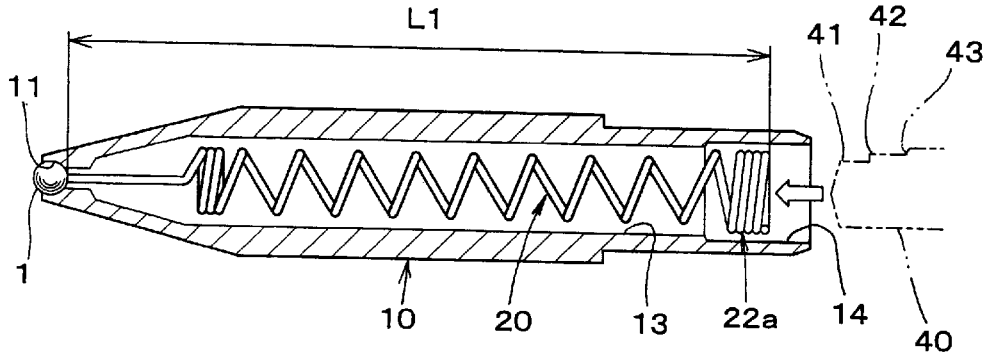
FIGS. 3A–3C are a longitudinal section for showing an assembling order in the chip for the ball-pointed pen, wherein 3A shows a state in which a resilient member is inserted into a holder, 3B shows a state in which a broach is inserted into the holder to form some small projections and 3C shows a state in which the broach is removed from within the holder.

As shown in FIG. 3A, at first, the resilient member 20 is inserted at its rear end side into the holder 10 having the transfer ball 1 held in the ball house 11. Under this state, an entire length L1 of the resilient member 20 is its maximum length (a free length) due to no reception at its rear end side.

Then, as shown in FIG. 3A, a broach 40 is inserted at a broach feeding segment 14 at the rear end of the holder 10 and a broach machining operation is carried out.

Figure 4:
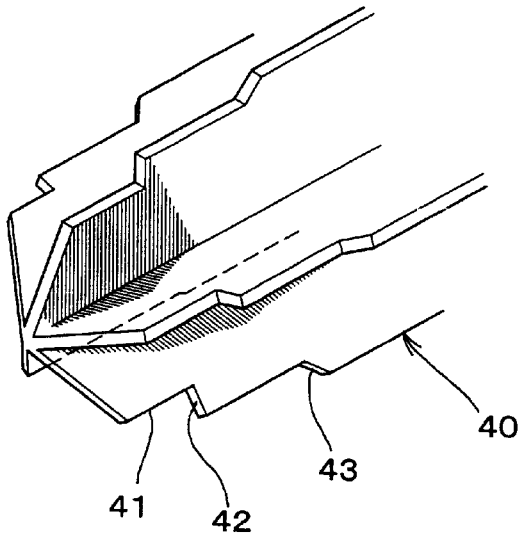
FIG. 4 is a perspective view for showing a broach used in machining for the chip for the ball-pointed pen.
Figure 5:
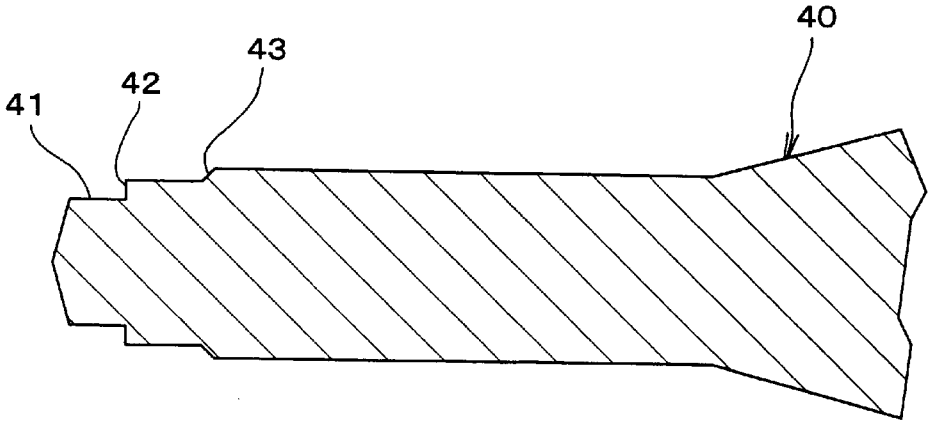
FIG. 5 is a sectional view for showing a blade of the broach in symmetrical manner in respect to an axial line.

As shown in FIGS. 4 and 5, the broach 40 is a rod-like jig having its extremity end formed into a radial sectional shape, wherein each of the pieces projecting toward the centrifugal direction at its extremity end is formed with a guide section 41 freely fitted into the seat wound segment 22*a* of the resilient member 20, a stepped receiving segment 42 for receiving the rear end of the spring segment 22, and a blade segment 43 for cutting and machining a groove at the rear part of the ink passage 13.

Accordingly, during the stage of inserting the broach 40 into the holder 10, at first the guide section 41 is freely fitted into the seat wound segment 22*a*, of the resilient member 20. Then, the spring segment 22 is compressed while the rear end of the seat wound segment 22*a* is being received by the stepped receiving segment 42.

Then, as the blade segment 43 passes by the rear end of the ink passage 13 and the broach 40 is further advanced, a groove 13*b* is cut and machined at the rear end of the ink passage 13 by the blade segment 43. In concurrent with this cutting operation, some cut pieces are produced at the front end of the groove 13*b*, the broach 40 is advanced to the predetermined position, thereby the cut pieces become some small projections 13*a* having such a height as one capable of receiving the rear end of the resilient member 20. Since the extremity end of the broach 40 is the blade segment comprised of a plurality of radial pieces, a plurality of small projections 13*a* are formed in a circumferential direction.

Figure 3B:
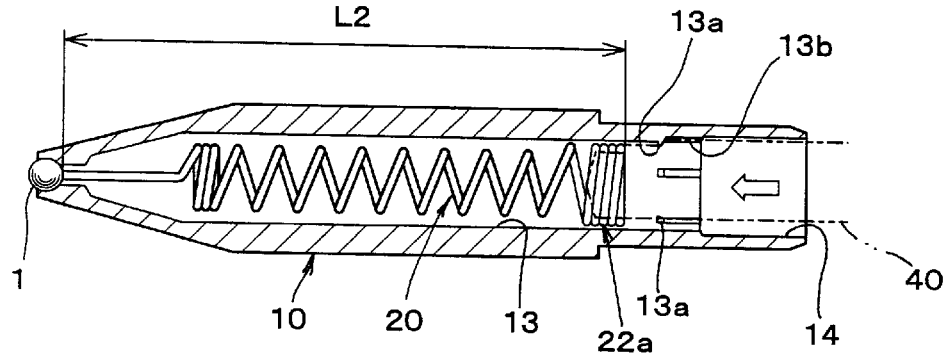

Further, when the broach 40 advances up to the predetermined position, the resilient member 20 is shrunk down to the entire length L2 shown in FIG. 3B due to the fact that the rear end of the resilient member is pushed by the stepped receiving segment 42 of the broach 40.

Figure 3C:
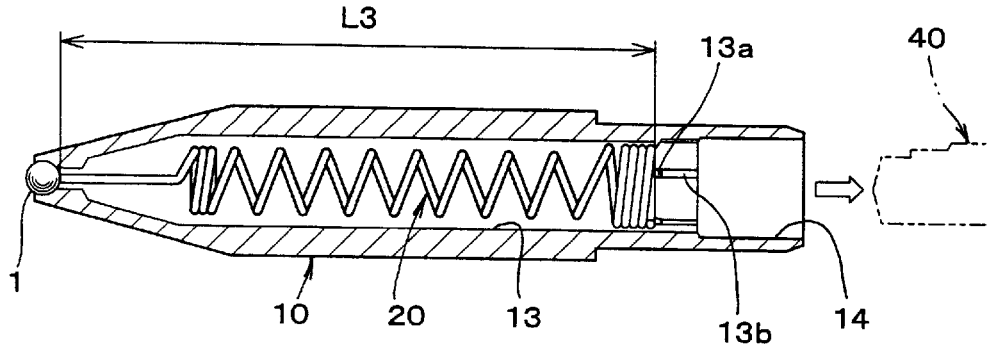

Next, as shown in FIG. 3C, the broach 40 is pulled out in a rearward direction. Then, the resilient member 20 of which rear end has been pushed by the stepped receiving segment 42 of the broach 40 is recovered and the rear end of the resilient member 20 is received by a plurality of small projections 13*a*. That is, the resilient member 20 is resiliently recovered to extend its entire length up to L3 indicated in FIG. 3C so as to cause the transfer ball 1 to be biased under a state of its entire length L3.

Thus, in accordance with the chip A having the aforesaid constitution, since the rear end of the resilient member 20 is received by a plurality of small projections 13a interrupted in a circumferential direction, the small projections 13*a* and the inner circumferential surface of the holder 10 do not become trouble when the deaeration at the centrifugal separating processing at the refill manufacturing step, resulting in that the air bubbles within the holder 10 are moved smooth in a rearward direction.

Further, the number of small projections 13*a* is not limited to 5 locations as shown in the illustrated figure.

In addition, although it is preferable to arrange the stepped receiving segment 42 in the broach 40 as illustrated in the preferred embodiment of the present invention, it is of course apparent that the stepped receiving segment 42 is not provided, but the resilient member 20 is compressed with the cut pieces formed while the cut pieces are being formed by the blade segment 43.

In accordance with the present invention, the resilient member is received by a plurality of small projections formed in the holder and when the deaeration is carried out by the centrifugal separating operation, it has no circular front end surface where some air bubbles are engaged like the sleeve as found in the prior art, resulting in that the air bubbles pass by a plurality of small protrusions not becoming trouble and further move smoothly in a rearward direction. Accordingly, the parts cost can be reduced due to the small projections of simple structure and it is possible to provide the high quality chip for the ball-pointed pen having no air bubbles left therein.

Further, if the cut pieces formed by the broach machining operation are utilized as small projections where the resilient member is received, the plurality of small projections can be formed easily within a short period of time.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A chip for a ball point pen comprising a metallic holder having an inner surface forming an ink passage, a ball housing at an extreme end of said metallic holder that holds a transfer ball, a resilient member provided in said ink passage that biases said transfer ball toward said extreme end, and a plurality of small integral projections provided at a rearward end of said metallic holder spaced along a circumferential direction on said inner surface of said metallic holder that extend toward said extreme end and receive a rearward end of said resilient member, wherein said plurality of small integral projections are formed by broach machining at said rearward end of said metallic holder.

2. A chip for a ball point pen according to claim 1, wherein said plurality of small integral projections are cut pieces.

3. A chip for a ball point pen according to claim 1, wherein said resilient member includes a coil spring segment at a rearward end of said metallic holder and a straight segment that extends from a central portion of said coil spring segment in a longitudinal direction of said ink passage toward said extreme end of said metallic holder and includes an end directly abutting said transfer ball.

4. A chip for a ball point pen according to claim 1, wherein each said small integral projection includes a free end, and wherein each said free end extends toward said extreme end of said metallic holder.

5. A chip for a ball point pen comprising a metallic holder having an inner surface forming an ink passage, a ball housing at an extreme end of said metallic holder that holds a transfer ball, a resilient member provided in said ink passage that biases said transfer ball toward said extreme end, said resilient member including a coil spring segment at a rearward end of said metallic holder and a straight segment that extends from a central portion of said coil spring segment in a longitudinal direction of said ink passage toward said extreme end of said metallic holder and includes an end directly abutting said transfer ball, and a plurality of small integral projections provided at a rearward end of said metallic holder spaced along a circumferential direction on said inner surface of said metallic holder that receive said rearward end of said resilient member, wherein said plurality of small integral projections are formed by broach machining at said rearward end of said metallic holder.

6. The chip for a ball point pen according to claim 5, wherein each said small integral projection includes a free end, and wherein each said free end extends toward said extreme end of said metallic holder.

7. A method of making a chip for a ball point pen, said method comprising:

providing a metallic holder having an inner surface forming an ink passage and a ball housing at an extreme end of said metallic holder that holds a transfer ball;

providing a resilient member, said resilient member including a coil spring segment and a straight segment that extends from a central portion of said coil spring segment;

inserting said resilient member in said ink passage through a rearward end of said metallic holder so that said coil spring segment is positioned at a rearward end of said metallic holder and said straight segment extends in a longitudinal direction of said ink passage toward said extreme end of said metallic holder and an end of said straight segment directly abuts said transfer ball;

inserting a broach in said ink passage through said rearward end of said metallic holder;

advancing said broach in said ink passage toward said extreme end of said metallic holder, thereby compressing said coil spring segment of said resilient member and cutting a plurality of small integral projections in said rearward end of said metallic holder spaced along a circumferential direction on said inner surface of said metallic holder; and removing said broach from said ink passage through said rearward end of said metallic holder so that said plurality of small integral projections receive said rearward end of said resilient member.

8. The method of making a chip for a ball point pen according to claim 7, wherein said coil spring segment of said resilient member includes a seat segment and said broach includes a guide segment that freely fits into said seat segment of said resilient member, a stepped receiving segment and a blade segment; wherein, inserting of said broach in said ink passage further includes freely fitting said guide segment of said broach in said seat segment of said resilient member; and advancing of said broach in said ink passage further includes compressing said coil spring segment with said stepped receiving segment and cutting said plurality of small integral projections with said blade segment.

* * * * *